US005092303A

United States Patent [19]

Brown

[11] Patent Number: 5,092,303

[45] Date of Patent: Mar. 3, 1992

[54] IN-LINE FUEL PRECONDITIONER

[75] Inventor: Paul M. Brown, Boise, Id.

[73] Assignee: Advanced Research Ventures, Inc., Nampa, Id.

[21] Appl. No.: 687,045

[22] Filed: Apr. 18, 1991

[51] Int. Cl.[5] ..... F02M 33/00

[52] U.S. Cl. ..... 123/538; 123/1 A; 123/3; 123/456

[58] Field of Search ..... 123/538, 536, 3, 1 A, 123/537, 539, 456

[56] References Cited

U.S. PATENT DOCUMENTS 3,635,200 1/1972 Rundell et al. ..... 123/538
3,855,980 12/1974 Weisz et al. ..... 123/3
4,267,976 5/1981 Chatwin ..... 123/538
4,715,325 12/1987 Walker ..... 123/1 A
4,858,582 8/1989 Brown ..... 123/1 A
4,862,836 9/1989 Chen et al. ..... 123/3

*Primary Examiner*—E. Rollins Cross
*Assistant Examiner*—M. Macy
*Attorney, Agent, or Firm*—Paul F. Horton

[57] ABSTRACT

A fuel preconditioner for catalytic cracking of long-chain liquid hydrocarbons, and particularly gasoline, for internal combustion engines. A tubular housing, in-line with the fuel pump and carburetor or fuel injection system, contains a platinum catalyst for the cracking of liquid hydrocarbons into more volatile components for superior combustion, Heater elements may be provided for acceleration of the catalytic action. In one embodiment, the tubular housing defines a fuel rail of a fuel injection system.

3 Claims, 1 Drawing Sheet

IN-LINE FUEL PRECONDITIONER

BACKGROUND OF THE INVENTION

1. Field of the Invention

This invention relates to fuel preconditioners and, more particularly, to preconditioners provided with a platinum catalyst for the cracking of long-chain hydrocarbon fuels.

2. Description of the Prior Art

The physical and chemical properties of gasoline for internal combustion engines are controlled by specifications designating the boiling range, volatility, octane number, etc. It is known that the octane number of straight run or cracked stocks can be increased by catalytic reforming over a platinum containing catalyst which isomerizes cyclopentanes into cyclohexanes and dehydrogenates napthenes to aromatics. It is also known that excessive cracking produces highly volatile gaseous products which are highly desirable for combustion, but which are not suitable for handling, storage, and dispensing. Furthermore, the petroleum industry is pressured to reduce volatility in order to reduce the amount of hydrocarbons escaping into the atmosphere, contributing to smog formation.

Efforts have been made to provide for superior combustion, as typified by U.S. Pat. No. 4,715,325, issued to C. W. Walker, which utilizes a specific crystalline metal alloy within the fuel line, to, which it is maintained, enhance the combustion process. Houseman, et al, U.S. Pat. No. 4,567,857 discloses a catalytic reactor which selectively decomposes methanol into a hydrogen rich product gas. The present, inventor, P. M. Brown, has devised a carburetor for the catalytic cracking of long chain hydrocarbons, disclosed in U.S. Pat. No. 4,838,582.

SUMMARY OF THE INVENTION

Applicant's present invention is a fuel preconditioner which provides catalytic cracking by an in-line housing or canister containing a platinum catalyst. The preconditioner is usable with all long chain, liquid hydrocarbon fuels and is usable with conventional carburetors and fuel ignition systems. A particular embodiment of the preconditioner provides a fuel rail with platinum catalyst for injection of the highly volatile components of the fuel into a mixing chamber.

It is therefore a primary object of the present invention to provide a preconditioner having a tubular housing containing a platinum catalyst for installation in the fuel line between pump and mixing chamber for the cracking of liquid, long-chain hydrocarbon fuels immediately before entry into a conventional carburetor or fuel injection system.

It is also an important object of the present invention to provide a fuel rail, for a fuel injection system, which contains a platinum catalyst for catalytic cracking of long-chain hydrocarbon fuel immediately before injection into an internal combustion engine.

Additional objects and advantages will become apparent and a more thorough and comprehensive understanding may be had from the following description taken in conjunction with the accompanying drawings forming a part of this specification.

DETAILED DESCRIPTION OF THE INVENTION

Figure 1:
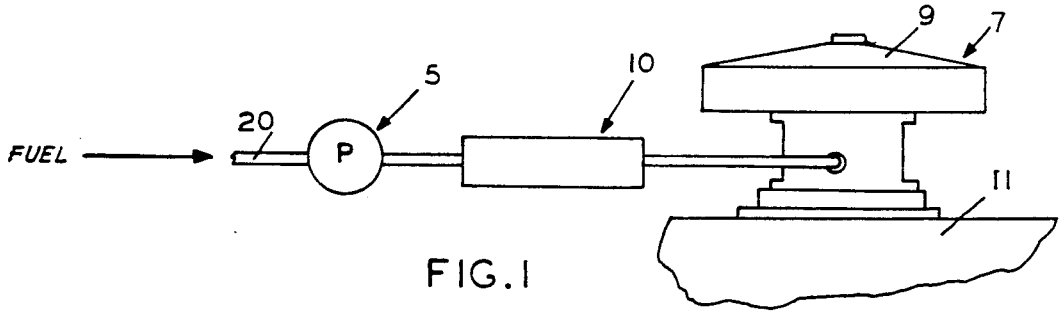
FIG. 1 is a schematic view showing one embodiment of the preconditioner of the present invention showing the device in-line with a conventional carburetor of an internal combustion engine.
Figure 2:
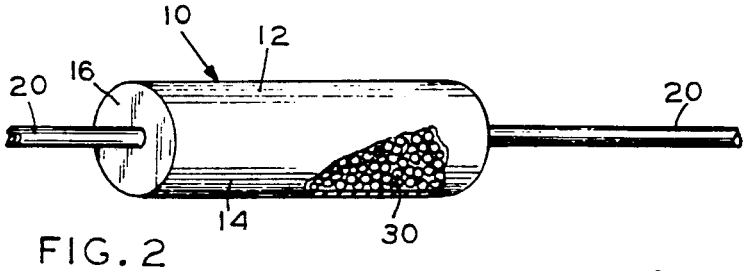
FIG. 2 is a perspective view, in partial section, of the device of FIG. 1, showing placement of the platinum catalyst within a tubular housing.
Figure 3:
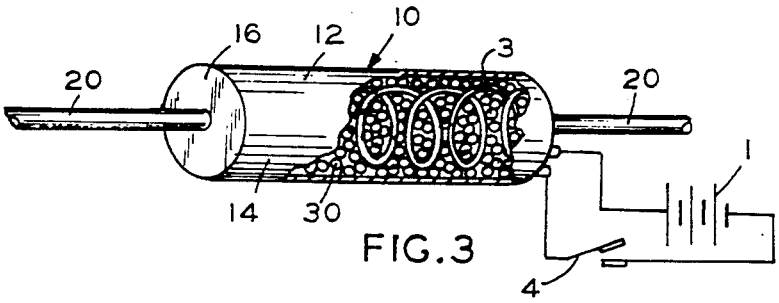
FIG. 3 is a prespective view, in partial section, of an electric heater contained within the housing for acceleration of the cracking process.

Referring to the drawings, and, more particularly, to FIGS. 1-3, a first embodiment to be preferred of an in-line fuel preconditioner 10, made according to the present invention, is disclosed. Preconditioner 10 is installed within a fuel line 20 between a fuel pump 5 and a conventional carburetor 7. Fuel drawn from a tank is pumped by pump 5, through preconditioner 10, into carburetor 7 where the fuel is mixed with air drawn through filter 9 and the mixture is then drawn or injected into intake manifold 11 of an internal combustion engine.

Preconditioner 10, as seen to advantage in FIG. 2, includes a tubular housing 12, having a side wall 14 and a pair of opposing end walls 16 to define a hollow canister. Fuel line 20 feeds into and away from the preconditioner through ports in the end walls thereof.

Located within housing 12 of preconditioner 10 is platinum catalyst 30. For maximizing contact between the fuel and the catalyst within the housing, the catalyst is preferably formed into a multiplicity of spherical beads. A fine mesh may be placed within the housing 12 to prevent movement of the catalytic beads from the housing.

Referring to FIG. 3, an electric heating element 3, shown in the form of a coil, is placed within housing 12. The heating element is connected by means of a switch 4 to an externally located power source, such as battery 1. Switch 4 is thermostatically controlled for regulating temperature within the preconditioner. Heat from the coil element 3 is transferred to the catalyst and to fuel within the housing to enhance and accelerate the cracking process. While the heating element is shown within the housing, it is obvious that the housing itself may be heated by an externally located element, with heat transference by the housing to the catalyst.

In operation, gasoline, or other long-chain hydrocarbons, liquid at atmospheric pressure and ambient temperature, is fed into the preconditioner by pump 5, where the fuel is brought into contact with the surface of catalyst 30. In that the products of the catalystic cracking and reforming of the fuels are highly volatile, it is desirable that preconditioner 10 be located in as close of apposition to the carburetor as is possible. It is to be noted that the volatile products enter carburetor 7 before any mixing with air and therefore a conventional carburetor may be used and the only changes in the system are the installation of the preconditioner into the existing fuel line and the connecting of heater wires to a battery, when applicable and as is preferred. It will be seen, then, that the cracking process, which is highly desirable because of increased combustion efficiency and hence greater economy with less pollution, is performed within the fuel line and immediately before use, thus eliminating the problems of storage and dispensing in catalytic cracking of fuels prior to entry into the fuel line.

Figure 4:
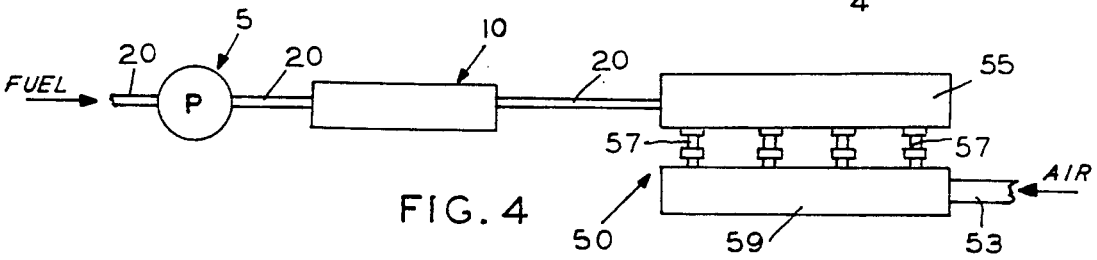
FIG. 4 is a schematic view showing the preconditioner of FIG. 1 in-line with a fuel injection system.

Referring to FIG. 4, it will be seen that preconditioner 10 may be installed into the fuel line after pump 5 and immediately before a fuel injection and air induction system, designated generally be the numeral 50. Catalytically cracked fuel coming from preconditioner 10 is fed into one or more fuel rails 55 from which it is forced, through injectors 57 into mixing chamber 59, which may be the intake manifold or directly into the cylinders of an internal combustion engine, as the case may be. The highly volatile fuel is mixed with air coming into the mixing chamber through an air line 53 and through an air filter, not shown.

Figure 5:
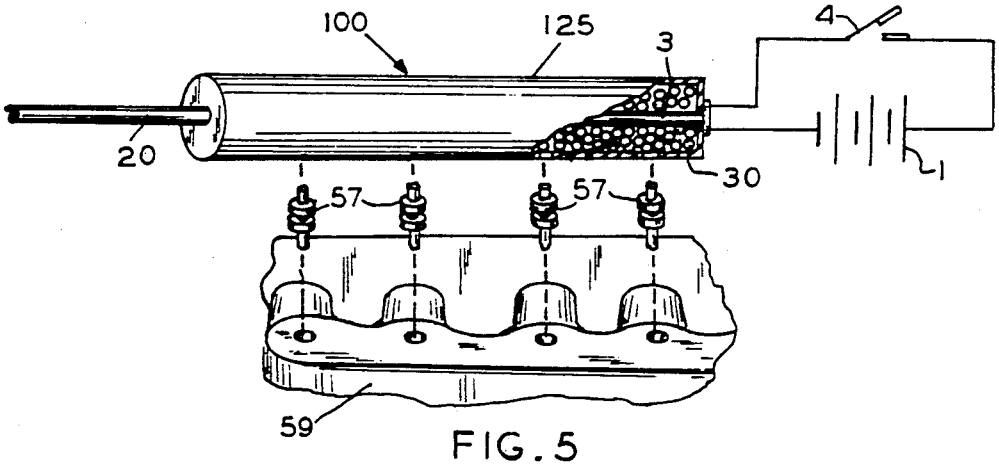
FIG. 5 is a perspective and expanded view of a second embodiment of the present invention showing the tubular housing, in partial section, and as defining a fuel rail of a fuel injection system.

Referring now to FIG. 5, a second embodiment of the present invention, a fuel preconditioner 100, used in conjunction with and as a part of a fuel injection system is shown. In this embodiment the tubular housing defines a fuel rail 125 of a fuel injection system. The fuel rail is connected to fuel line 20 and holds platinum catalyst 30, also in the form of small beads for increasing surface area. Rail 125 may be provided with an electric heating element 3, also connected to a power source, battery 1, by means of a thermostatically controlled switch 4, as in the first embodiment shown. The catalytic beads are prevented from blocking fuel injectors 57 by means of their size or by a fine mesh, not shown. Fuel leaving fuel rail 125 is injected directly into the mixing chamber 59, which may be the intake manifold, as shown, or individual cylinders. In that the preconditioner is incorporated directly into and made a part of the fuel rail, the catalytic cracking of the fuel is accomplished at the nearest point possible to the mixing chamber of the system, with the rail providing the dual functions of even dispersement as well as catalytic cracking of the fuel. Cost and space requirements are also held to a minimum.

Having thus described in detail a preferred selection of embodiments of the present invention, it is to be appreciated and will be apparent to those skilled in the art that many physical changes could be made in the apparatus without altering the inventive concepts and principles embodied therein. The present embodiments are therefore to be considered in all respects as illustrative and not restrictive, the scope of the invention being indicated by the appended claims rather than by the foregoing description, and all changes which come within the meaning and range of equivalency of the claims are therefore to be embraced therein.

I claim:

1. An in-line fuel preconditioner for catalytic cracking of liquid hydrocarbon fuel for internal combustion engines, comprising:

one or more tubular housings, each housing defining a fuel rail of a fuel injection system, each of said fuel rails having an inlet port connected in line with a fuel source and a plurality of outlet ports, each of said outlet ports feeding a fuel injector for injection of fuel into a mixing chamber of an internal combustion engine; and a platinum catalyst contained with each of said fuel rails for catalytic cracking of liquid hydrocarbon fuel coming into contact therewith.

2. The preconditioner as described in claim 1 further comprising heating means for heating of said catalyst to enhance the cracking process.

3. The preconditioner as described in claim 2, wherein said heating means comprises a thermostatically controlled electric heating element.

* * * * *